US006349485B1

(12) United States Patent
Reed

(10) Patent No.: US 6,349,485 B1
(45) Date of Patent: Feb. 26, 2002

(54) APPARATUS FOR COOLING AND CONDITIONING OF GRAIN

(75) Inventor: Carl Reed, Manhattan, KS (US)

(73) Assignee: Kansas State University Research Foundation, Manhattan, KS (US)

( * ) Notice: Subject to any disclaimer, the term of this patent is extended or adjusted under 35 U.S.C. 154(b) by 0 days.

(21) Appl. No.: 09/523,043

(22) Filed: Mar. 10, 2000

Related U.S. Application Data

(63) Continuation-in-part of application No. 09/211,244, filed on Dec. 14, 1998.

(51) Int. Cl.[7] ..... F26B 25/06
(52) U.S. Cl. ..... 34/232; 454/182
(58) Field of Search ..... 34/230, 232, 235, 34/507, 565; 454/171, 172, 173, 174, 175, 176, 181, 182

(56) References Cited

U.S. PATENT DOCUMENTS

| | | | | | |
|---|---|---|---|---|---|
| 101,759 | A | * | 4/1870 | Munn | 454/175 |
| 3,136,240 | A | | 6/1964 | Rabe | |
| 4,033,466 | A | * | 7/1977 | Easton | 214/17 CB |
| 4,256,029 | A | * | 3/1981 | Steffen et al. | 98/55 |
| 4,520,714 | A | * | 6/1985 | Gullickson | 98/56 |
| 4,530,167 | A | * | 7/1985 | Hotovy | 34/47 |
| 4,885,985 | A | * | 12/1989 | Pollock | 98/55 |

OTHER PUBLICATIONS

Loo, Silo Storage in Malaysia, Preserving Grain Quality by Aeration and In–store Drying; Proceedings of an international seminar held at Kuala Lumpur, Malaysia, Oct. 9–11, 1985.

Hunter, Design of Air Distribution Systems and Fan Selection for Grain Aeration, Preserving Grain Quality by Aeration and In–store Drying; Proceedings of an international seminar held at Kuala Lumpur, Malaysia, Oct. 9–11, 1985.

Aeration of Grain in Commercial Storages; USDA; Marketing Research Report No. 178.

* cited by examiner

*Primary Examiner*—Denise L. Esquivel
*Assistant Examiner*—Greg T. Warder
(74) *Attorney, Agent, or Firm*—Hovey, Williams, Timmons & Collins

(57) ABSTRACT

A high capacity grain aeration apparatus (10) is provided which includes opposed, upright, tubular, ported inlet and outlet ducts (24,26) positioned within a grain bin (12) and having inlet and outlet fans (28, 30) adjacent the upper ends of the ducts (24, 26). The ducts (24, 26) preferably present smooth, uncorrugated walls (40, 44). In use, aeration air is directed through the inlet duct (24) and then transversely through the ports (42) to the interior (20) of grain bin (12). Such air flows transversely through the grain within bin (12) and is pulled upwardly through outlet duct (26) by means of outlet fan (30). Additional aeration air enters through vents (50) or the grain inlet port (47) and enters the outlet duct ports (46) by passing through the grain.

26 Claims, 1 Drawing Sheet

10
30
47
51a
14
50
51
38
34
28
36
CONTROLLER
52
44
26
32
40
12
24
22
46
18
-20-
42
48

10
47
14
38
H
36
26
12
24
Hw
18
16

APPARATUS FOR COOLING AND CONDITIONING OF GRAIN

CROSS-REFERENCE TO RELATED APPLICATION

This is a continuation-in-part of application Ser. No. 09/211,244 filed Dec. 14, 1998.

BACKGROUND OF THE INVENTION

1. Field of the Invention

This invention relates to the field of grain aeration. More particularly, the invention is concerned with an apparatus for grain aeration to effect cooling, conditioning (e.g., partial drying) or fumigating grain stored in upright bins. In preferred forms, the invention provides grain aeration apparatus including upright, opposed, tubular perforate air inlet and outlets ducts within a grain bin with a fan assembly for forcing air through the inlet duct, transversely through the stored grain within the bin, and then upwardly through the outlet duct.

2. Description of the Prior Art

The standard grain aeration systems either push or pull air through the height of the grain using a fan located at the base of the grain bin, the top of the grain bin or a combination of fans on both top and bottom of the grain bin. Because the air must traverse the entire height of the grain mass, resistance to airflow is great, and large fans that consume large amounts of electrical power must be used to achieve acceptably large airflow. An alternative apparatus places two semi-circular, perforated, corrugated, metal ducts vertically on the sides of the bin to move air through grain stored in the bin horizontally instead of vertically. However, installation of the semi-circular ducts on the walls is costly and the weight of the grain causes damage to the corrugated ducts as grain is withdrawn from the silo. A hole, near the bottom of the grain bin is still required for the installation of the aeration fan and/or duct.

A 1985 publication by K. F. Loo entitled *Silo Storage in Malaysia,* Proceedings of International Seminar held at Kuala Lampur, Malaysia, Oct. 9–11 (1985) describes a grain aeration system comprising perforated air inlet and outlet ducts with axial fans coupled to the ducts. However, this reference makes use of identically sized (10 hp) fans.

Another reference *Aeration of Grain in Commercial Storages* published by the U.S. Department of Agriculture discloses an aeration system with opposed perforate ducts, that makes use of only a single exhaust fan.

SUMMARY OF THE INVENTION

The present invention solves the problems mentioned above and provides a distinct advance in the state of the art. In particular, the apparatus for aeration of grain hereof is efficient and economical to install, operate and maintain.

The preferred grain aeration apparatus of the present invention is operated in combination with a grain bin. The grain aeration apparatus includes inlet and outlet ducts positioned adjacent the inside face of the grain bin wall and extending along at least a portion of the height thereof. The duct walls are preferably smooth and un-corrugated, with ports distributed along a portion of their length. An inlet fan is attached to the inlet duct's upper end. The inlet fan forces aeration air through the inlet duct, out the inlet ports and into grain stored in the bin. An outlet fan is attached to the upper end of the outlet duct. The outlet fan pulls air from the outlet duct and thereby pulls aeration air from grain stored in the bin through the outlet ports. The outlet fan is relatively larger than the inlet fan in terms of air-moving capacity in order to move more air than is supplied by the inlet fan. Thus air is pulled from the grain surface in a separate airpath than the duct-to-duct flow, in order to cool or condition the grain above the level of the perforations.

In preferred forms, the inlet and outlet duct are formed from synthetic resin pipe. The duct walls are imperforate for a distance of 1.5 to 1.9 bin diameters below the top of the grain bin, after which the ports consist of between 6 and 8% of the remaining duct surface area. Each pipe section is approximately 20 feet long, and requires only two attachment brackets per section. The preferred outlet fan is relatively larger than the inlet fan and both fans are positioned on top of the grain bin. Furthermore, it is preferred that the outlet duct be positioned in proximity to the area within the grain bin where the grain height is the greatest. This is done in order to keep air from "short-circuiting" within the bin.

In alternate embodiments, the aeration system of the invention includes level sensor(s) located within the grain bin and operable to determine the level of grain therein, and particularly whether or not the level of grain in the bin is above the level of the duct ports.

DETAILED DESCRIPTION OF THE PREFERRED EMBODIMENTS

Figure 1:
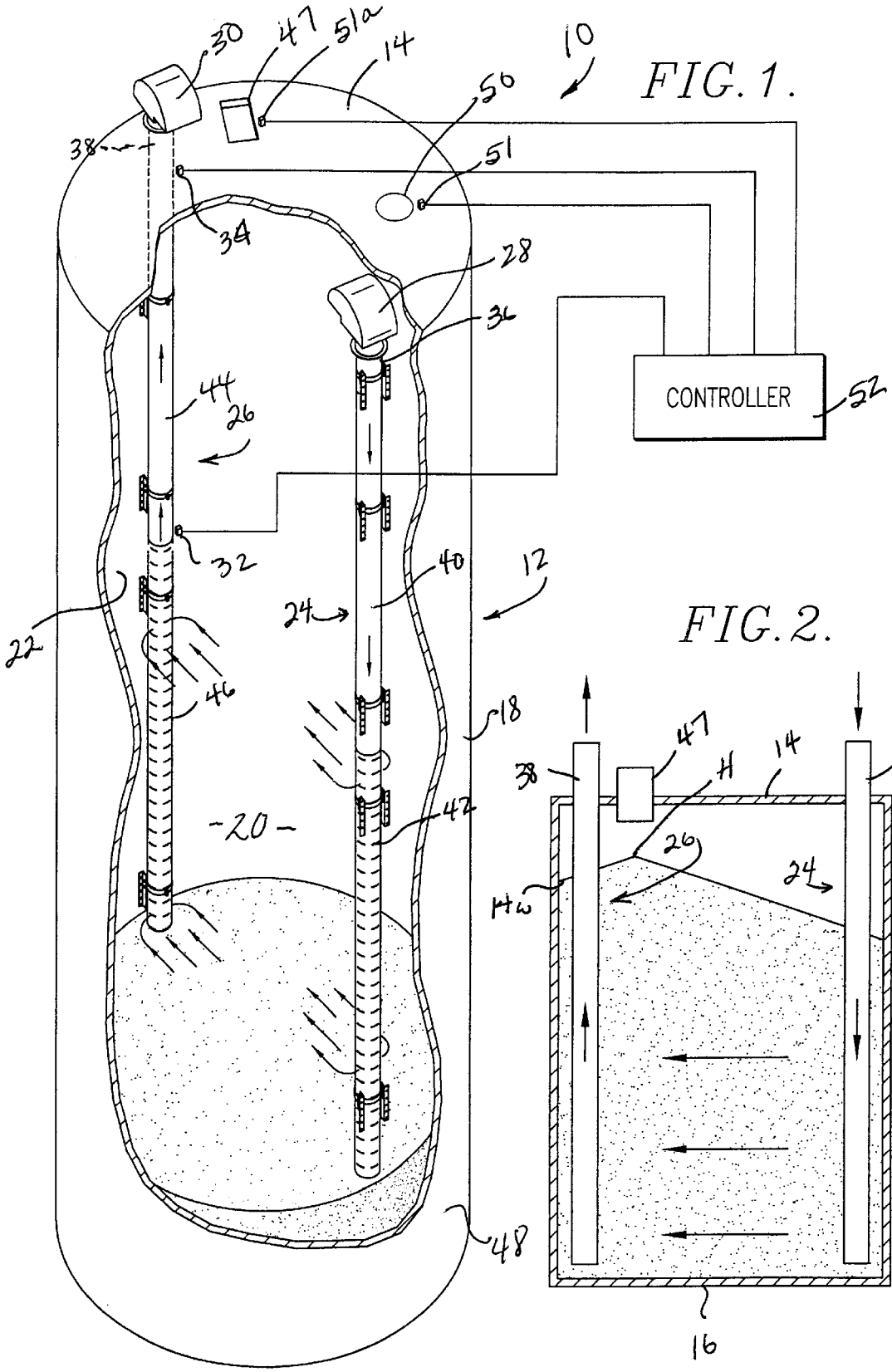
FIG. 1 is a pictorial, perspective view with portions of the bin wall removed to illustrate the internal construction of the preferred grain aeration apparatus in accordance with the present invention.

The drawing figures illustrate the preferred grain aeration apparatus 10 in combination with grain bin 12 in accordance with the present invention. Referring initially to FIG. 1, grain bin 12 includes top 14, bottom 16 and bin wall 18 therebetween defining bin interior 20. Bin wall 18 presents inside face 22.

Grain aeration apparatus 10 includes tubular inlet duct 24, tubular outlet duct 26, inlet fan 28, outlet fan 30, low sensor 32 and high sensor 34. The inlet fan 28 is connected to upper end 36 of inlet duct 24 and outlet fan 30 is connected to upper end 38 of outlet duct 26. Air propelled into the bin by the inlet fan 28 passes down the inlet duct 24 and into the grain through the inlet ports 42. This air passes through the grain and enters the outlet duct 26 through the ports 46, providing a duct-to-duct airflow.

Figure 2:
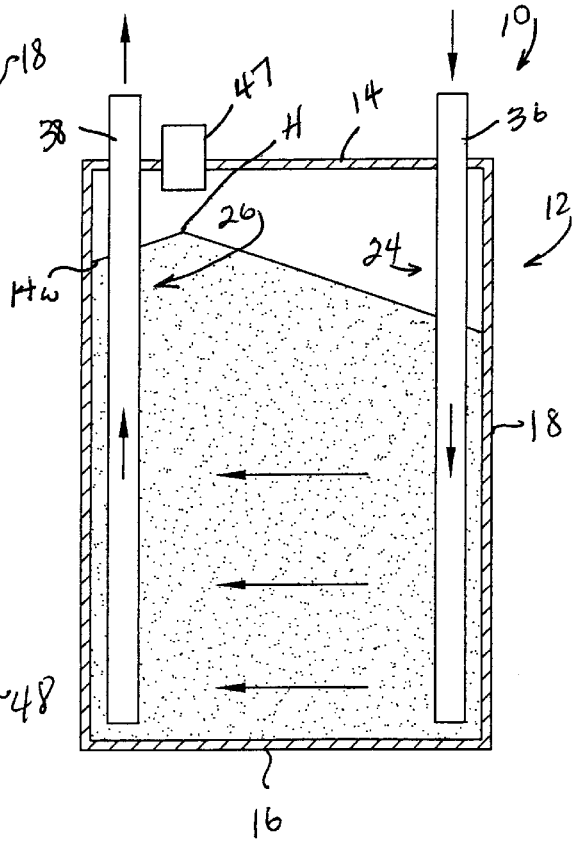
FIG. 2 is a schematic vertical sectional view of the preferred grain aeration apparatus, illustrating the position of the grain inlet relative to the outlet duct in order to prevent short circuiting of air.

As shown in FIG. 1, inlet duct 24 preferably presents a smooth, uncorrugated duct wall 40 with structure defining a plurality of inlet ports 42 along at least a portion of the height thereof. Outlet duct 26 also preferably presents a smooth, uncorrugated duct wall 44 with structure defining a plurality of outlet ports 46 along at least a portion of the height thereof. Outlet duct 26 is positioned opposite inlet duct 24 and close to a grain entry port 47 to ensure maximum length of the airflow path from the grain surface to outlet ports 46, thus preventing short circuiting. In particular, and referring to FIG. 2, it will be observed that the maximum height H of the grain within the bin 12 is closely adjacent to outlet duct 26. In this fashion, the outlet duct 26 is also close to the maximum height of the grain on the bin wall (Hw).

Cooling air seeks the shortest path through the grain within the bin 12. Therefore, placement of the outlet duct 26 relative to the inlet 47 as shown ensures that a cooling air current traverses the body of grain rather than passing along the upper surface of the grain from the inlet duct to the outlet duct.

Both ducts 24, 26 are electrically grounded to eliminate static charge build up. Ports 42, 46 are positioned along duct walls 40, 44 starting at a point from about 1.5 to 1.9 diameters of grain bin 12 below the grain height Hw, during normal operation of the apparatus 10. Also, ports 42, 46 present an open area of between about 6% and 8% of the total surface area of the perforated portions of the inlet and outlet ducts 24, 26, respectively.

Inlet and outlet ducts 24, 26, as illustrated in FIG. 1, are preferably formed of synthetic resin material (PVC) pipe with a 16" diameter. Ducts 24, 26 are assembled in 20' long sections of PVC pipe and are coupled with inside face 22. PVC pipe is preferred for low cost, light weight and easy assembly.

Inlet fan 28 and outlet fan 30 are preferably positioned on top 14 of grain bin 12 and are conventionally connected to the upper ends of respective ducts 24, 26. Outlet fan 30 is larger than inlet fan 28. Specifically, outlet fan 30 is sized between 3 and 5 horsepower and inlet fan 28 is sized between 0.75 and 1 horsepower to provide optimum cooling and conditioning airflow. Outlet fan 30 pulls outlet air from outlet duct 26 and thereby pulls aeration air from grain stored within bin interior 20 by way of outlet ports 46. Vents 50 and fill port 47 supply aeration air to the volume of grain above ports 42, 46. This aeration air flows in through vents 50 and fill port 47, down through that volume of grain above ports 42, 46 and into outlet ports 46. This cools and conditions the topmost portion of the grain stored in grain bin 12 by a surface-to-duct airflow. Because fans 28, 30 are respectively attached to upper ends 36,38 above grain bin top 14, there is no need for an opening in bin wall 18. This reduces construction costs and eliminates the need to weaken bin 12 structure by cutting an opening at base 48 of bin wall 18 where grain pressures are greatest.

Low grain level sensor 32 is positioned adjacent bin wall 18 and placed such that it senses when grain levels cover ports 42, 46. High grain level sensor 34 is positioned adjacent bin wall 18 and placed such that it can determine when grain bin 12 is full. Vents 50, defined in the grain bin top 14, are shiftably covered by schematically depicted vent closer 51 shiftably operable between open and closed positions. Fill port 47 described previously is the opening through which grain enters the bin 12. Fill port 47 is equipped with a fill port closer 51*a,* which is shiftably operable between open and closed positions. Sensors 32, 34 are conventionally connected with the vent and fill port closers, and the motor controls for inlet and outlet fans 28, 30.

As shown in FIG. 1, the sensors 32, 34 are coupled with a conventional microprocessor controller 52, which is also coupled with vent and fill port closers 51, 51*a* and the motor controls for inlet and outlet fans 28, 30.

In operation, if low sensor 32 does not detect grain covering ports 42, 46, then the low sensor signals controller 52 and the fans 28, 30 are turned off. This prevents short circuiting of aeration air through empty interior space of bin 20.

If the low sensor 32 detects grain covering ports 42, 46, but high sensor 34 does not detect grain, then fans 28, 30 are enabled by a signal from controller 52. Also, controller 52 signals vent closer 51 and fill port closer 51*a* to shift to the closed position. This results in all of the aeration air passing through the inlet duct 24. That is, inlet fan 28 operates to force aeration air through inlet duct 24 and out through inlet ports 42 into grain located in bin interior 20. Outlet fan 30 operates to pull outlet air from outlet duct 26 and thereby pull aeration air from grain stored within bin interior 20 by way of outlet ports 46. In this way, all of this aeration air follows a course through grain stored in said bin 12 generally transverse relative to the height thereof.

If high grain level sensor 34 detects a sufficient grain level, then controller 52 signals vent closer 51 and fill port closer 51*a* to shift to the open position and aeration air enters bin interior 20 from vents 50, grain fill port 47 and inlet duct 24.

Table 1 clearly demonstrates the airflow and ratios of surface-to-duct vs. duct-to-duct airflow rates of the present invention used with wheat or grain sorghum. Likewise, Table 2 demonstrates the airflow and ratios of surface-to-duct vs. duct-to-duct airflow rates of the present invention used with corn or soybeans.

TABLE 1

Estimated airflow and ratios of surface-to-duct vs. duct-to-duct airflow rates in a cross-flow aeration system used with WHEAT or GRAIN SORGHUM

| Exhaust Fan HP | Inlet Fan HP | Bin Diameter | Bin Height | Total Airflow (cfm/bu) | Surface-to-Duct Airflow (% of total) | Duct-to-Duct Airflow (% of total) |
|---|---|---|---|---|---|---|
| 3 | 0.75 | 20 | 80 | 0.09 | 55 | 45 |
| 3 | 0.75 | 20 | 100 | 0.07 | 55 | 45 |
| 3 | 0.75 | 20 | 120 | 0.06 | 56 | 44 |
| 3 | 1 | 20 | 80 | 0.09 | 40 | 60 |
| 3 | 1 | 20 | 100 | 0.07 | 40 | 60 |
| 3 | 1 | 20 | 120 | 0.06 | 41 | 59 |
| 5 | 1 | 20 | 80 | 0.14 | 64 | 36 |
| 5 | 1 | 20 | 100 | 0.11 | 64 | 36 |
| 5 | 1 | 20 | 120 | 0.1 | 64 | 36 |

TABLE 2

Estimated airflow and ratios of surface-to-duct vs. duct-to-duct airflow rates in an cross-flow aeration system used with CORN or SOYBEANS

| Exhaust Fan HP | Inlet Fan HP | Bin Diameter | Bin Height | Total Airflow (cfm/bu) | Surface-to-Duct Airflow (% of total) | Duct-to-Duct Airflow (% of total) |
|---|---|---|---|---|---|---|
| 3 | 0.75 | 20 | 80 | 0.14 | 53 | 47 |
| 3 | 0.75 | 20 | 100 | 0.11 | 52 | 48 |
| 3 | 0.75 | 20 | 120 | 0.09 | 52 | 48 |
| 3 | 1 | 20 | 80 | 0.14 | 39 | 61 |
| 3 | 1 | 20 | 100 | 0.11 | 39 | 61 |
| 3 | 1 | 20 | 120 | 0.09 | 38 | 62 |
| 5 | 1 | 20 | 80 | 0.18 | 54 | 46 |
| 5 | 1 | 20 | 100 | 0.14 | 53 | 47 |
| 5 | 1 | 20 | 120 | 0.11 | 53 | 47 |

As it will be appreciated, aeration apparatus 10 can be installed as an original aeration system on a newly built grain bin or installed as a kit on a preexisting grain bin. The kit would normally include all parts of the aeration apparatus 10, and would allow any pre-existing vents or fans to be incorporated into the aeration apparatus 10. For a grain bin 120' tall, for example, the kit would include 4 nonperforated 20' sections of 16" diameter PVC ducts, 8 perforated 20' sections of 16" diameter PVC ducts, two mounting brackets per section, inlet fan 28 and outlet fan 30.

Those skilled in the art will now appreciate the benefits of the present invention. For example, the low friction coefficient of smooth, uncorrugated ducts 24, 26, decreases the damage caused by the removal of grain from a bin with corrugated metal ducts. Another benefit is smaller fans may be used to cool and condition the grain because aeration air travels transversely across bin 12 as opposed to the entire height of bin 12. Smaller fans are less expensive to purchase and operate. Also, because fans 28,30 are attached to ducts 24, 26 above top 14, no opening has to be made in bin wall 18. This reduces construction costs and eliminates the need to weaken the bin structure by cutting an opening in the base of the wall where grain pressures are the greatest.

Those skilled in the art will also appreciate that the present invention encompasses many variations in the preferred embodiments described herein. For example, inlet and outlet ducts 24,26 could be made from other materials with low friction coefficients such as ceramics, aluminum or other synthetic resin materials. Also, the preferred embodiment is made of 16" ducts, but other sizes could be used. As another example, either one or both of fans 28, 30 could be positioned on the side of grain bin 12. The size and location of ports 42, 46 could be varied. Additionally vent 50 could be defined in bin wall 18 or there could be a plurality of vents 50. Further, a recirculating fumigant system could be connected with the aeration system to treat grain more efficiently and more thoroughly.

Having thus described the preferred embodiments of the present invention, the following is claimed as new and desired to be secured by Letters Patent:

I claim:

1. In combination:

a grain bin having a top, a bottom and a bin wall therebetween presenting an inside face; and a grain aeration apparatus including a tubular inlet duct positioned adjacent said inside face and extending along at least a portion of the height thereof and presenting an upper end, said inlet duct including smooth, un-corrugated duct walls and structure defining a plurality of inlet ports distributed along at least a portion of said inlet duct wall, an inlet fan coupled with said upper end of said inlet duct, a tubular outlet duct positioned adjacent said inside face and extending along at least a portion of the height thereof, opposite said inlet duct and presenting an upper end, said outlet duct including smooth, uncorrugated duct walls and structure defining a plurality of outlet ports distributed along at least a portion of said outlet duct wall, an outlet fan coupled with said upper end of said outlet duct, said inlet fan being operable to force aeration air through said inlet duct and out through said inlet ports in order to inject aeration air into grain stored in said grain bin, said outlet fan being operable to pull outlet air from said outlet duct and thereby pull aeration air from grain stored within said grain bin by way of said outlet ports, at least a portion of said outlet air being aeration air supplied by said inlet duct, having followed a course through grain stored in said bin, generally transverse to the height thereof, said outlet fan having a larger capacity than said inlet fan.

2. The combination of claim 1, said bin presenting a diameter, said inlet and outlet ports being positioned between about 1.5 and 1.9 bin diameters below said grain bin top.

3. The combination of claim 2, said inlet and outlet ducts each presenting a perforated surface area, said ports presenting an open area of between about 6 and 8% of said perforated surface area.

4. The combination of claim 1, said ducts being formed from synthetic resin pipe.

5. The combination of claim 1, said ducts being coupled with said inside face.

6. The combination of claim 1, including at least one level sensor included in said grain bin interior, said sensor operable to determine whether the level of grain in said bin is above the level of said ports.

7. The combination of claim 6, said sensor being operable to enable said fans when the grain level in said bin is higher than said ports.

8. The combination of claim 6, said level sensor being a low level sensor, said apparatus further including a high level sensor positioned above said low level sensor, said bin including at least one vent, said at least one vent being selectively positionable in an open and a closed position, said sensors being connected to said at least one vent and being operable to close said vent, said high sensor being operable to open said vent once a certain grain level height is reached.

9. The combination of claim 1, said outlet fan being between 3 and 5 horsepower and said inlet fan being between 0.75 and 1 horsepower.

10. The combination of claim 1, said outlet fans being positioned on top of said grain bin.

11. The combination of claim 1, said bin including a vent defined in said top, said outlet fan being sized and oriented in order to draw aeration air through said vent and downwardly through the grain above said ports.

12. The combination of claim 11, said bin presenting a diameter, said inlet and outlet ports being positioned between about 1.5 and 1.9 bin diameters below said grain bin top, said inlet and outlet ducts being formed of synthetic resin pipe, said inlet and outlet fans being positioned on top of said grain bin and said outlet fan being between 3 and 5 horsepower and said inlet fan being between 0.75 and 1 horsepower.

13. A grain aeration apparatus, for use with a grain bin including:

a tubular inlet duct positionable adjacent an inside face of a grain bin and extending along at least a portion of the height thereof and presenting an upper end, said inlet duct including smooth, uncorrugated duct walls and structure defining a plurality of inlet ports distributed along at least a portion of said inlet duct wall, an inlet fan coupled with said upper end of said inlet duct, a tubular outlet duct positionable adjacent said inside face of the grain bin and extending along at least a portion of the height thereof, opposite said inlet duct and presenting an upper end, said outlet duct including smooth, un-corrugated duct walls and structure defining a plurality of outlet ports distributed along at least a portion of said outlet duct wall, an outlet fan coupled with said upper end of said outlet duct, said inlet fan being operable to force aeration air through said inlet duct and out through said inlet ports in order to inject aeration air into grain stored in the grain bin, said outlet fan being operable to pull outlet air from said outlet duct and thereby pull aeration air from grain stored within the grain bin by way of said outlet ports, at least a portion of said outlet air being aeration air supplied by said inlet duct, having followed a course through grain stored in the bin, generally transverse to the height thereof, said outlet fan having a higher capacity than said inlet fan.

14. The apparatus of claim 13, said inlet and outlet ducts each presenting a perforated surface area, said ports presenting an open area of between about 6 and 8% of said perforated surface area.

15. The apparatus of claim 13, said ducts being formed from synthetic resin pipe.

16. The apparatus of claim 13, said outlet fan being larger than said inlet fan.

17. The apparatus of claim 16, said outlet fan being between 3 and 5 horsepower and said inlet fan being between 0.75 and 1 horsepower.

18. The apparatus of claim 13, said inlet and outlet ports being located in spaced relationship below the top of said inlet and outlet ducts respectively, there being a vent located in cooperation with said outlet fan so that said outlet fan draws aeration air through said vent and downwardly through the grain above said ports.

19. In combination:

a grain bin having a top, a bottom and a bin wall therebetween presenting an inside face; and a grain aeration apparatus including a tubular inlet duct positioned adjacent said inside face and extending along at least a portion of the height thereof and presenting an upper end, said inlet duct including structure defining a plurality of inlet ports distributed along the length thereof;

an inlet fan coupled with said upper end of said inlet duct;

tubular outlet duct positioned adjacent said inside face and extending along at least a portion of the height thereof in generally opposed relationship with said inlet duct and presenting an upper end, said outlet duct including structure defining a plurality of outlet ports distributed along at least a portion of said outlet duct wall;

an outlet fan coupled with said upper end of said outlet duct, said inlet fan being operable to force aeration air through said inlet duct and out through said inlet ports in order to inject aeration air into grain stored in said grain bin;

said outlet fan being operable to pull outlet air from said outlet duct and thereby pull aeration air from grain stored within said grain bin by way of said outlet ports, at least a portion of said outlet air being aeration air supplied by said inlet duct, having followed a course through grain stored in said bin, generally transverse to the height thereof, said outlet fan having a larger capacity than said inlet fan in order to move more air than is supplied by the inlet fan.

20. The combination of claim 19, said inlet duct and said outlet duct each having smooth, uncorrugated duct walls.

21. The combination of claim 19, said bin including a vent defined in said top, said outlet fan being sized and oriented in order to draw aeration air through said vent and downwardly through the grain above said ports.

22. In a grain aeration apparatus including a grain bin having an upright bin sidewall presenting an inside face, a ported tubular inlet duct position adjacent said inside face and extending along a portion of the height thereof and having an upper end, a ported tubular outlet duct positioned adjacent said inside face in generally opposed relationship with said inlet duct and extending along a portion of the bin and having an upper end, an inlet fan coupled with the upper end of the inlet duct, and an outlet fan coupled with the upper end of the outlet duct, the improvement which comprises said outlet fan having a larger capacity than said inlet fan in order to move more air than is supplied by the inlet fan.

23. The apparatus of claim 22, including at least one level sensor located within said bin and operable to determine whether the level of grain in the bin is above the level of at least certain of the ports of said inlet and outlet ducts.

24. The apparatus of claim 22, said outlet duct located in said grain bin at a region where the height of the grain is greatest.

25. The apparatus of claim 22, said inlet and outlet ports being located in spaced relationship below the top of said inlet and outlet ducts respectively, said grain bin including a top, said top having a vent, said outlet fan being sized and oriented to draw aeration air through said vent and downwardly through the grain above said ports.

26. In a grain aeration apparatus including a grain bin having an upright bin sidewall presenting an inside face, atop wall, a ported tubular inlet duct position adjacent said inside face and extending along a portion of the height thereof and having an upper end, a ported tubular outlet duct positioned adjacent said inside face in generally opposed relationship with said inlet duct and extending along a portion of the bin and having an upper end, an inlet fan coupled with the upper end of the inlet duct, an outlet fan coupled with the upper end of the outlet duct, and a grain fill port in said top wall, the improvement which comprises positioning said grain fill port substantially closer to said outlet duct than to said inlet duct, and locating the outlet duct in said grain bin close to said grain fill port and the region below the grain fill port where the height of grain is the greatest.

* * * * *